United States Patent [19]

Eheim

[11] 3,974,814

[45] Aug. 17, 1976

[54] SPEED REGULATOR FOR FUEL INJECTION PUMPS

[75] Inventor: Franz Eheim, Stuttgart, Germany

[73] Assignee: Robert Bosch G.m.b.H., Stuttgart, Germany

[22] Filed: Jan. 7, 1975

[21] Appl. No.: 539,250

[30] Foreign Application Priority Data

Jan. 23, 1974 Germany ..... 2403081

[52] U.S. Cl. ..... 123/139 ST; 123/140 R

[51] Int. Cl.[2] ..... F02M 39/00; F02D 1/04

[58] Field of Search ..... 123/140 R, 140 J, 139 ST, 123/179 L

[56] References Cited

UNITED STATES PATENTS

| | | | |
|---|---|---|---|
| 3,613,651 | 10/1971 | Snyder | 123/140 R |
| 3,638,631 | 2/1972 | Eheim | 123/139 ST |
| 3,847,127 | 11/1974 | Staudt | 123/140 R |
| 3,884,205 | 5/1975 | Staudt et al. | 123/140 R |

*Primary Examiner*—Charles J. Myhre
*Assistant Examiner*—Paul Devinsky
*Attorney, Agent, or Firm*—Edwin E. Greigg

[57] ABSTRACT

A speed regulator for fuel injection pumps of internal combustion engines includes an intermediate lever pivotable about a pin carried by a shaft which is coupled via a head to a fuel quantity adjustment member of a fuel injection pump. The pin is eccentrically disposed in a shaft which fits within a bushing disposed in the housing of the pump. The shaft is acted on by a speed signalling device with speed dependent force against the arbitrarily variable force of a main control spring. A speed signalling device acts on the intermediate lever. A one-armed drag lever, pivotable about the same axis defined by the pin, about which the intermediate lever pivots, may be provided. In this case, the drag lever is acted on by the main control spring, which otherwise acts directly on the intermediate lever. The shaft is guided in a bushing eccentrically inserted in the housing of the pump and is rotatable and arrestable from without. A stop for limiting maximum full load fuel quantity is vertically spaced by the same amount from the fuel quantity measuring member and the speed signalling device.

4 Claims, 3 Drawing Figures

SPEED REGULATOR FOR FUEL INJECTION PUMPS

BACKGROUND OF THE INVENTION

1. Field of the Invention

This invention relates to a speed regulator for fuel injection pumps of internal combustion engines. The present invention is concerned, more particularly, with a speed regulator for fuel injection pumps of internal combustion engines, the regulator including at least one intermediate lever for transferring the control function via a path. This intermediate lever is acted on by a speed signalling device against the arbitrarily variable force of a main control spring and is coupled to a flow quantity adjustment member of the injection pump. The intermediate lever is pivotable as far as a stop for limiting the full load quantity about a journal eccentrically disposed on a shaft.

In a known speed regulator for fuel injection pumps of this type the intermediate lever is pivotable on an axis which is adjustable owing to its eccentric disposition, the eccentric being used to adjust the full load quantity and to stop the pump, while the fuel is reduced to a minimum.

2. Description of the Prior Art

In the case of another known speed regulator for fuel injection pumps of the type described above, in place of only one intermediate lever, an intermediate lever and a drag lever associated with this intermediate lever and pivotable about the same axis are provided. The main control spring of the speed signalling device acts on the drag lever. A starting spring acts on the intermediate lever so that the speed signallng device must first overcome the force of the starting spring before the intermediate lever can rest against the drag lever. In this way an excess quantity of fuel, which cuts off automatically as the speed increases, is obtained for starting. The control path for cutting off the excess starting fuel which, with this arrangement is connected in series with the main regulating path of the speed regulator, requires a greater working capacity, for example, of a centrifugal force governor operating as the speed signalling device. In order to be able to use the same speed signalling device as in the arrangement described initially, in which only a single intermediate lever is provided, the control ratio between the speed signalling device and the flow quantity adjustment member must be altered, that is, the lever arm between the axis of the intermediate lever and the flow quantity adjustment member must be enlarged. Both of the above described known speed regulators for injection pumps can possess essentially the same components up to the lever arrangement, but it is not possible to replace one lever arrangement by the other when the injection pump is otherwise constructed in essentially the same way.

OBJECT AND SUMMARY OF THE INVENTION

The principal object of the present invention is to provide a speed regulator for a fuel injection pump of the type described initially for changing the controlling ratio when using different intermediate levers of differing construction. For example, instead of a simple intermediate lever, a double lever arrangement, as described above, can be used with an otherwise identical injection pump without the working capacity of the speed signalling device and the adaptability of the injecion pump being substantially unfavorably influenced thereby.

This problem is solved according to the present invention in that the shaft, which effects the movement of the fuel quantity adjustment member of the fuel injection pump, is eccentrically guided in a bushing which is inserted in the housing of the injection pump and which is rotatable and arrestable from without and in that a stop for limiting the maximum full load quantity is vertically spaced apart from the flow quantity adjustment member by the same distance as the speed signalling device. With this arrangement, the axis about which the intermediate lever or the intermediate lever and a further drag lever are pivotable can be adjusted to alter the control ratio. The two end positions of the eccentricity advantageously act as adjustment means for two differently connected lever arrangements. By arranging the stop for determining the full load quantity at the same distance from the flow quantity adjustment member as the axis of the speed signalling device, the position of this stop can be retained without the working capacity of the speed signalling device being effected. An advantageous feature of the invention consists in that the bushing has a flange which is disposed outside of the fuel injection pump housing and which can be locked in position by a pressure element. In this way a changeover can easily be effected.

A further advantageous feature consists in that the stop for limiting the maximum full load quantity is adjustable.

Other objects, features and advantages of the present invention of an improved speed regulator for fuel injection pumps are to become apparent from the following detailed description of two preferred embodiments thereof, reference being made to the accompanying drawing figures.

DESCRIPTION OF THE PREFERRED EMBODIMENTS

Figure 1:
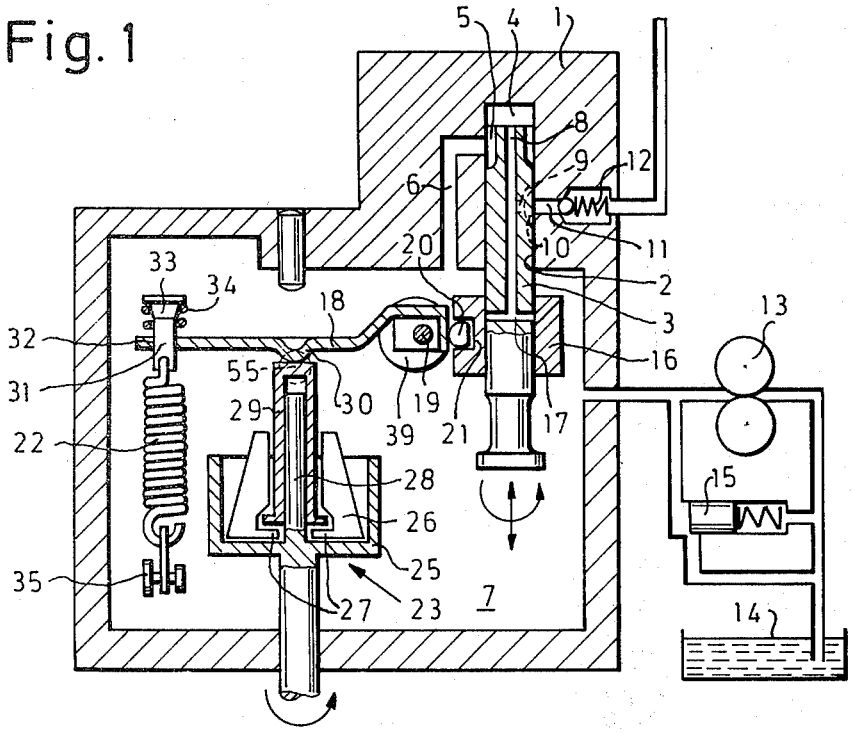
FIG. 1 is a cross-sectional, front elevational view of a first embodiment of a speed regulator for a fuel injection pump according to the present invention, a single intermediate lever for adjusting the flow quantity adjustment member being present, the regulator being illustrated in combination with a fuel injection pump and supply, shown schematically.

Referring to FIG. 1, a pump piston 3 operates in a cylinder bore 2 in a housing 1 of a fuel injection pump. The pump piston 3 is displaced in a simultaneous reciprocating and rotating movement by conventional instrumentalities (not shown) against the force of a restoring spring which is also not represented. A working chamber 4 of the pump is supplied with fuel from a suction chamber 7, via a longitudinal groove 5 disposed in the surface of the pump piston 3 and, via a channel 6, disposed in the housing 1, as long as the pump piston 3 makes its intake stroke and takes in its lower dead center position. As soon as the channel 6 has been closed after commencing the compression stroke and after a corresponding rotation of the pump piston 3, the fuel in the pump working chamber 4 is conveyed along a longitudinal channel 8 provided in the pump piston 3, during the movement of the pump piston 3. From the longitudinal channel 8 the fuel is supplied via a radial bore 9, which branches off, and a longitudinal distributor groove 10 disposed in the surface of the pump piston 3 to one of fuel pressure lines 11, only one pressure line 11 being shown in FIG. 1. The pressure lines 11 are distributed on the circumference of the cylinder bore 2 in correspondence with the number of cylinders to be supplied. Each of the pressure lines 11 supply fuel, via a respective check valve 12 opening in the flow direction to respective injection valves (not represented) of the individual cylinders of the internal combustion engine supplied by the injection pump. The suction chamber 7 is supplied with fuel via a pump 13 from a fuel container 14. The pressure in the suction chamber 7 is controlled, in a manner known per se, by a pressure control valve 15 disposed parallel to the pump 13.

A cylindrical slide 16 is displaceable on the pump piston 3. This cylindrical slide 16 regulates a radial bore 17 which is in fluid communication with the longitudinal channel 8 during the compression stroke of the pump piston 3 and thus provides a direct communication between the working chamber 4 and the suction chamber 7. From this point in time on the remaining fuel supplied by the pump piston 3 is not supplied to the pressure lines 11, but flows into the suction chamber 7. Thus, according to the position of the cylindrical slide 16 connection is made sooner or later to the suction chamber 7 and the fuel supply to the pressure lines 11 is interrupted. The further the cylindrical slide 16 is pushed in the direction of the upper dead center point of the pump piston 3, the greater the quantity of fuel which is supplied by the pump piston 3 to the pressure lines 11.

The cylindrical slide 16 is displaced by an intermediate lever 18 which is pivotable about a pine 19. A head 20 which engages in a recess 21 in the cylindrical slide 16 is accordingly provided on a lever arm of the intermediate lever 18. A centrifugal force governor 23 acting as the speed signalling device engages on the other arm of the intermediate lever 18 and acts against the force of a main control spring 22. The centrifugal force governor 23, which is driven via a gear unit (not illustrated) according to the speed of the pump piston 3 includes carrier 25 provided with compartments in which centrifugal weights 26 are disposed which engage with nose-shaped parts 27 with a sleeve 29 which is axially displaceable on an upstanding shaft 28 of the centrifugal force governor 23. During rotation, the centrifugal weights 26 are deflected by centrifugal force and consequently push the sleeve 29 upwardly. The sleeve 29, in turn displaces the intermediate lever 18 against the force of the main control spring 22.

To transfer this adjustment, with the least friction and momentum, the sleeve 29 engages on a semi-spherical, downwardly extending part 30 of the intermediate lever 18. The main control spring 22 is suspended on a bolt 31 which penetrates the intermediate lever 18 at its outer end through a bore 32 and on the other side thereof it includes a head 33. Between the head 33 and the intermediate lever 18 an idling spring 34 is provided. At its other end, the main control spring 22 is articulated on an arbitrarily adjustable lever 35, which is used to adjust the bias or load.

Figure 2:
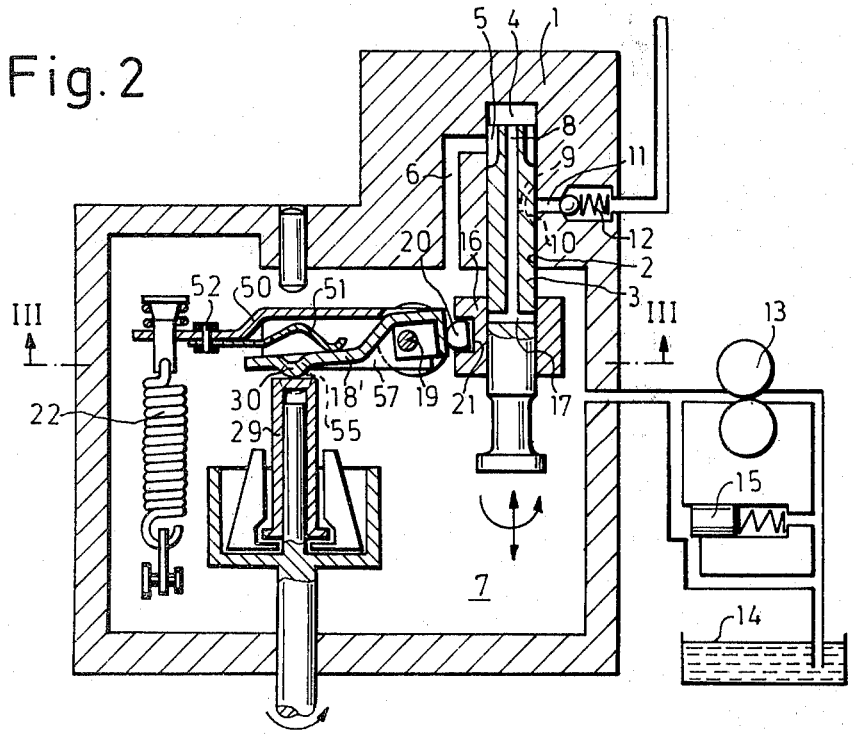
FIG. 2 is a cross-sectional, front elevational view of a second embodiment of a regulator according to the present invention, an intermediate lever and a drag lever associated therewith being present, the regulator being illustrated in combination with a fuel injection pump and supply, shown schematically.
Figure 3:
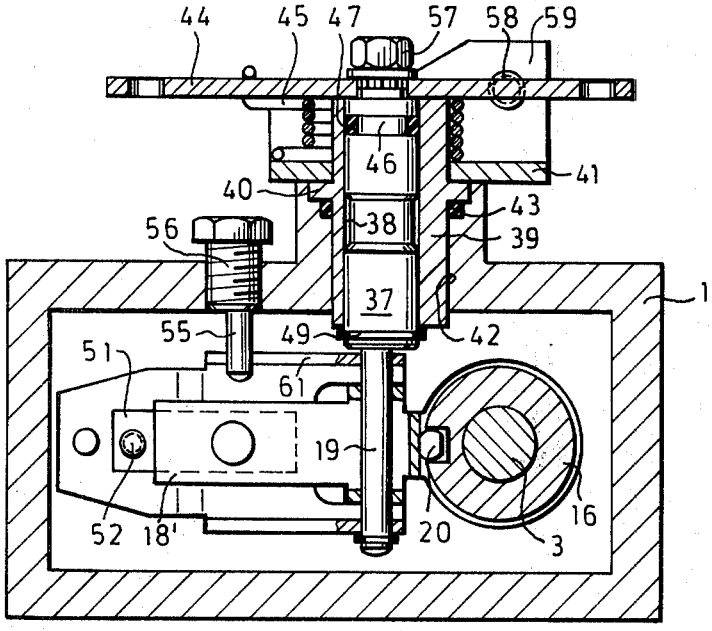
FIG. 3 is a sectional, partial view of the speed regulator for fuel injection pumps of FIG. 2, the section being taken along section line III—III.

The pin 19 is disposed eccentrically on a shaft 37, as best seen in FIG. 3, which fits closely in a bore 38 of a bushing 39 disposed in the housing 1 and is rotatable therein. This bushing 39 and the features which will be described hereinafter are made apparent in FIG. 3, which corresponds to the arrangement shown in FIGS. 1 and 2, with the exception of the configuration of the intermediate lever. The bore 38 is eccentrically disposed in the bushing 39 and thus, when the bushing 39 is displaced, the shaft 37 is also displaced. The bushing 39 has a flange 40 by means of which it is pressed by a fastening plate 41, which, for example, is screwed to the pump housing 1, into a wider portion of the bore 42 which receives the bushing 39. A sealing element 43 is provided in this wider portion for sealing purposes. The bushing 39 can be secured in a specific position which was determined in advance, by the fastening plate 41. The fastening plate 41 bears an adjustable stop for an adjustable lever 44 which is rigidly connected to the shaft 37 via a nut 57 which is pressed onto this stop via a restoring spring 45. The stop consists of a part of a screw 58 which is screwed into a part 59 of the fastening plate 41, this part 59 being bent at right angles and a check nut being provided to secure the same. the initial adjustment of the cylindrical slide 16 can be obtained via the shaft 37 and the pin 19 by the adjustable lever 44 and its stop on the fastening plate 41. In addition, by pivoting the adjustable lever 44 against the force of the restoring spring 45 the quantity of fuel can be reduced to a minimum. If an adjustable stop, which is displaceable by a specific amount and which is constructed in a manner known per se is used in place of the screw 58, the lever 44 in FIG. 1 can, for example, be rotated against this stop and thus the cylindrical slide 16 can be moved into a positon corresponding to a starting excess of fuel. A sealing ring 47 is provided in an annular groove 46 of the shaft 37 in the region of the bore 38. The shaft 37 is protected in the axial direction by a retaining ring 49 and the adjustable lever 44.

The fuel injection pump represented in diagrammatic form in FIG. 2 differs from that of FIG. 1 in the construction of the lever transfer arrangement between the centrifugal force governor 23 and the cylindrical slide 16. In this second embodiment of a speed regulator for fuel injection pumps, an intermediate lever 18' is provided which, as in the case of the arrangement according to FIG. 1, is pivotable about a pin 19 and engages on one side with a head 20 in a recess 21 of the cylindrical slide 16. A semi-cylindrical part 30 on which a sleeve 29 of the centrifugal force governor 23 engages is also provided on the other lever arm of the intermediate lever 18'. In contrast to the arrangement according to FIG. 1, the main control spring 22 is not articulated on the intermediate lever 18'. A single-arm drag lever 50 is provided for this purpose. The drag lever 50 is also pivotable about the pin 19 and the main control spring 22 is secured to its end in the same fashion as in FIG. 1. A leaf spring 51 is also secured to the drag lever 50 by means of a rivet 52. The leaf spring 51 is supported by its free end on the intermediate lever 18' and it can be deformed by the latter until it rests against the drag lever 50. In the course thereof the intermediate lever 18' and the drag lever 50 overlap and, to accommodate the leaf spring 51, they are both cropped so that when the levers 18', 50 rest against each other an intermediate space having a cross-section similar to a parallelogram is produced.

The leaf spring 51 is used to produce a starting excess of fuel in such a manner that when the injection pump is not in operation and accordingly when the centrifugal force governor 23 is at rest, the levers 18', 50 are spread apart by the leaf spring 51 and the intermediate lever 18' rests against the sleeve 29. As a result, the cylindrical slide 16 is in its uppermost position corresponding to a maximum fuel delivery capacity. When the pump commences to operate, as the speed increases, the intermediate lever 18' is displaced by the sleeve 29 against the force of the leaf spring 51 until, on reaching a specific speed, which is determined by the stiffness of the leaf spring 51, the intermediate lever 18' rests against the drag lever 50. During this process, the cylindrical slide 16 is pushed downwardly in the direction of a lesser quantity of fuel and when the levers 18', 50 rest against each other, the position of the cylindrical slide 16 corresponds to the normal full load quantity. On reaching this point the starting excess of fuel is ceased and the fuel quantity regulation is determined solely by the main control spring 22.

As the additional movement of the intermediate lever 18 necessitates a larger regulating path for the centrifugal force governor 23 with the same control ratio between the centrifugal force governor 23 and the cylindrical slide 16, it is necessary to change this ratio if the same centrifugal force governor is to be retained. The distance between the point where the sleeve 29 is to contact the intermediate lever 18 and its point of rotation should be less than in the arrangement according to FIG. 1 and the distance between the pin 19 and the pivotal point of the intermediate lever 18' via the head 20 on the cylindrical slide 16 must be greater. The tension of the main control spring 22 must also be varied accordingly.

This adjustment is made possible by the bushing 39. As is apparent from FIG. 3, which corresponds to a section along section line III—III of the device as shown in FIG. 2, the shaft 37 is located in its leftmost position by the rotation of the bushing 39. In order to use only a single lever, in place of the two lever arrangements according to FIG. 2, the bushing 39 must be rotated and the shaft 37 brought into its other end position. Advantageously, the eccentricity can be adapted to the particular lever arrangement which is employed so that double the amount of the eccentricity is equal to the necessary displacement of the pin 19. Other corrective steps can be taken by rotating the shaft 37.

FIG. 3 also shows a full load stop 55 which is not shown in FIGS. 1 and 2. The stop 55 is embodied as a pin disposed at right angles to the axis of the shaft 28 of the centrifugal force governor 23 and eccentrically mounted on a shaft 56 inserted in the housing 1 and is rotatable and accordingly the stop 55 is adjustable. In the lever arrangement according to FIG. 1, in the full load position the intermediate lever 18 rests against the stop 55 while in the arrangement according to FIG. 2 the drag lever 50, the position of which determines the fuel delivery quantity after the starting excess has been discontinued, comes to rest against the stop 55 in the full load position. In this embodiment the drag lever 50 is provided with an offset side piece 61 for this purpose.

The positioning of the stop 55 for the full load quantity at the same distance from the fuel delivery adjustment member, the slide 16, or from the piston 3 as the shaft 28 of the centrifugal force governor 23 or the point of contact of the centrifugal force governor 23 on the swivel lever 18 or drag lever 50 is an especially advantageous feature of this invention.

If the full load stop 55 were located, for example, at the end of the intermediate lever, as is generally the case, after adjusting the fuel injection pump, by displacing the pin 19 together with the cylindrical slide 16 or some other fuel delivery adjustment member by rotating the shaft 37, the full load stop 55 would also have to be adjusted. This would be necessary because during the adjustment routine the intermediate lever would be pivoted in its entirety about the stop and the working capacity of the centrifugal force governor would also be influenced at this time. However, a precise adjustment could then only be effected at considerable expense.

With the adjustment feature of the above arrangement the full load stop 55 fortunately does not have to be adjusted after the adjustment routine as the working capacity of the centrifugal force governor is no longer influenced. During the adjustment step, the intermediate lever 18 or the drag lever 50, as the case may be, is tilted about the stop 55 and thus does not change its position at the point of contact of the speed signalling device. The adjustment of the main control spring 22 which is then necessary, can be easily compensated from without further adaptation and adjustment steps.

The positioning of the stop 55 is similarly effective when adjusting the bushing 39.

The foregoing description and accompanying figures of drawing relate to embodiments of the present invention set out by way of example, not by way of limitation. It is to be appreciated that numerous other embodiments and variants are possible within the spirit and scope of the present invention, the scope being defined by the appended claims.

What is claimed is:

1. In a speed regulator for fuel injection pumps of internal combustion engines having a speed regulating device which includes: a housing; at least one intermediate lever; a pin eccentrically disposed on a shaft mounted to the housing, said intermediate lever being pivotably mounted to the housing by said pin; full load fuel quantity stop means; a speed signalling device mounted to the housing and in engagement with the intermediate lever for transferring thereto a control function; a main control spring connected to one end of the intermediate lever, with the other end of the intermediate lever being coupled to a flow quantity adjustment member of a fuel injection pump, said intermediate lever being pivotable about said pin, as far as the stop means for limiting the full load fuel quantity, the improvement comprising a bushing including an eccentrically disposed bore within which said shaft is inserted for adjusting the axis about which the intermediate lever is pivotable, said shaft being rotatable and arrestable externally of the housing, wherein the stop means for limiting the maximum full load fuel quantity and the speed signalling device are vertically spaced by the same amount from the flow quantity adjustment member for retaining the position of the stop means without affecting the working capacity of the speed signalling device.

2. A speed regulator for fuel injection pumps as claimed in claim 1, wherein said bushing includes a flange outside of said housing of said injection pump, said flange being secured by a fastening plate.

3. A speed regulator for fuel injection pumps as claimed in claim 2, wherein said stop for limiting the maximum full load quantity is adjustable.

4. A speed regulator for fuel injection pumps as claimed in claim 1, wherein said stop for limiting maximum full load quantity is adjustable.

* * * * *